United States Patent [19]

Walker

[11] Patent Number: 4,819,671

[45] Date of Patent: Apr. 11, 1989

[54] ACCESSORY FOR THE HAIR

[76] Inventor: Lindsey J. Walker, 1 Norfolk Road, St. John's Wood, London NW8, Great Britain

[21] Appl. No.: 726,020

[22] Filed: Apr. 22, 1985

Related U.S. Application Data

[63] Continuation of Ser. No. 395,913, Jul. 7, 1982, abandoned.

[30] Foreign Application Priority Data

Jul. 13, 1981 [GB] United Kingdom ..... 8121555
Nov. 13, 1981 [GB] United Kingdom ..... 8134352

[51] Int. Cl.[4] ..... A45D 8/00
[52] U.S. Cl. ..... 132/54
[58] Field of Search ..... 132/52–55

[56] References Cited

U.S. PATENT DOCUMENTS

D. 205,576 8/1966 Day ..... 132/54 UX
250,967 12/1881 Presser ..... 132/53
2,567,119 9/1951 Naidor ..... 132/53 X
3,435,832 4/1969 Ito ..... 132/54

FOREIGN PATENT DOCUMENTS 624164 7/1927 France ..... 132/48 R

*Primary Examiner*—Richard J. Apley
*Assistant Examiner*—John Welsh
*Attorney, Agent, or Firm*—Kirschstein, Kirschstein, Ottinger & Israel

[57] ABSTRACT

An accessory for the hair comprising a fringe and securing means, attached to one edge of the fringe, suitably comprising a head band formed for example in an open curve of firm material having resilience so as to grip the sides of a user's head and having projections to engage the head. The fringe in use overlies the user's forehead and may comprise real or synthetic hair, strips, or strings of beads depending from the securing means. The fringe may have a plurality of layers of different colors suitably attached to respective subsidiary band, for attachment to the head band. The accessory may be provided as a kit of parts.

There is also a display device for fashion accessories having a surface with representations of human faces with means for retaining accessories in suitable positions thereon.

5 Claims, 4 Drawing Sheets

ACCESSORY FOR THE HAIR

This is a continuation of application Ser. No. 395,913 filed July 7, 1982, now abandoned.

The present invention relates to hair accessories.

According to the invention there is provided an accessory for the hair comprising a single decorative, horseshoe-shaped arch having an inner and an outer surface, made of rigid material and adapted, in use, releasably to engage, be retained on and extend substantially from ear to ear over a forward part of the head of the wearer so as to be visible on top of the hair of the wearer, and a fringe having a free end and remotely therefrom a further end attached to said arch at said inside surface thereof so as, in use, to extend from one side only of said arch forwardly over the hair at the front of the head and over the forehead of the wearer.

The invention may, for example, provide a useful fashion accessory which can be obtained at moderate cost and easily removably fitted to the head to cause a change in the appearance of the wearer which could, if desired and depending on the composition of the fringe, be unusual and striking.

Suitably, the fringe comprises real or synthetic hair head. A suitable material is resilient plastics. Instead of real or synthetic hair, the fringe could comprise strips depending from the arch. The strips could be any desired shapes, such as elongated diamond shapes and a suitable material is coloured plastic. The strips may be attached so as to depend in overlapping fashion. As another alternative, the fringe could comprise strings of beads depending from the arch. The strips or strings of beads could be releasably attached to a arch to permit interchanging.

In one form, the arch includes a subsidiary band attached to both the fringe and the arch. The subsidiary band may be permanently attached to the arch or alternatively there could be releasable attachment means, such as material sold under the trade mark "Velcro" between the arch and the subsidiary band.

Portions of the fringe may be coloured in respective different colours and, if bright colours are used, special effects can be achieved.

In one preferred form of the present invention, the fringe has two or more layers of hair or other material each attached to the arch, so as in use to overlie the forehead on the user. This would permit an appearance of layering if the fringe was suitably cut or arranged. Advantageously, two or more of the layers respectively comprise material of different colours. For example, one layer could be blue and another layer red. The accessory may be supplied with a complete overlap between the layers when attached to the arch, so that only the front layer is visible. The customer can then cut the front layer as desired to reveal an area of the differently coloured layer directly behind. Alternatively, the accessory could be sold with two or more layers of different lengths overlapping so as to present, in use, different coloured portions of respective layers. Each layer could comprise material of more than one colour, with for example a common colour such as silver being present in each layer.

The invention will now be described, by way of example, with reference to the accompanying diagrammatic drawings in which.

Figure 1:
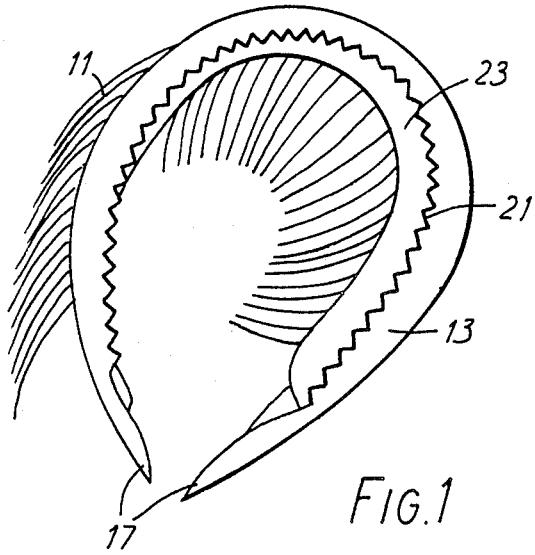
FIG. 1 is a view of an embodiment of an accessory according to the present invention.
Figure 2:
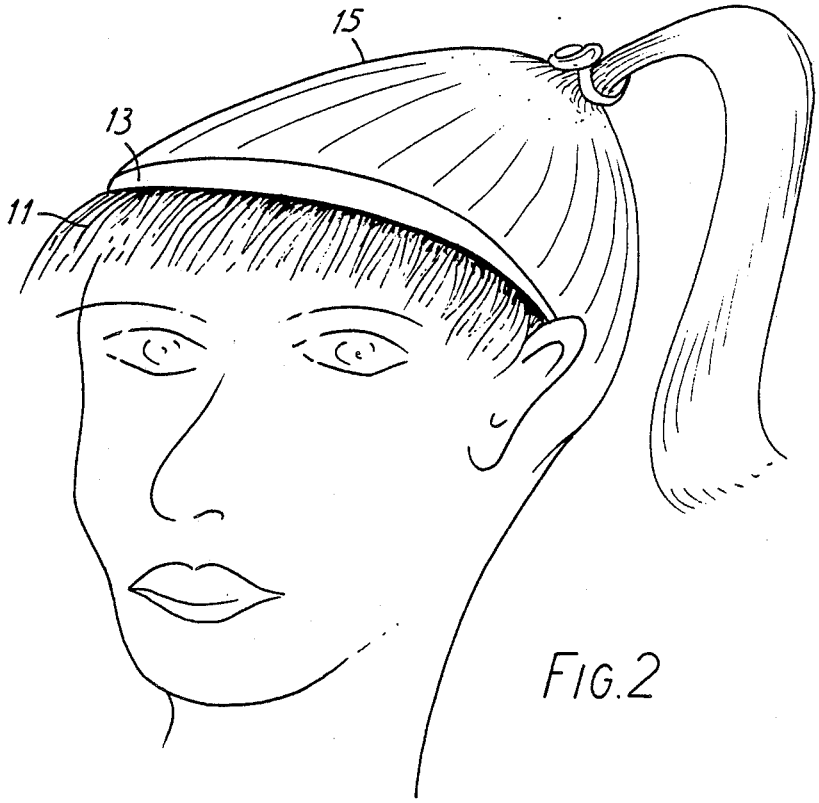
FIG. 2 is a view of the accessory of FIG. 1 on the head of a user.

Referring to FIGS. 1 and 2, an accessory is shown comprising a fringe 11 and a a single arch 13 composed of firm plastics material in an arch in the shape of a horseshoe. The free ends of the arch are resiliently separable to facilitate engagement and retention on the head with ends 17 located behid the ears of the user. The rear underside edge of the arch is formed with a row of serrations 21 which assist in retaining the fringe in position. Fringe 11 is composed of synthetic hair and the upper edge is glued between a double length of fabric strip 23. One edge of the strip 23 is glued to the underside of the arch 13 forwardly of the serrations, to extend along most of the length of the arch.

In use, as shown in FIG. 2, the accessory is positioned on the user's head with the serrations engaging the hair or head of the user 15 and the fringe 11 overlying the forehead on the user, the fabric strip 23 being hidden beneath the arch 13.

Figure 3:
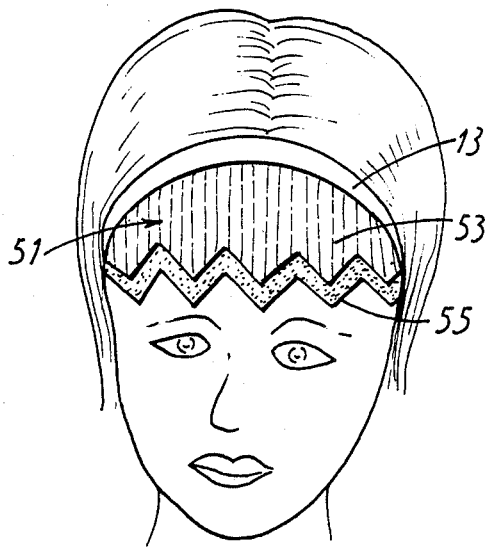
FIG. 3 is a view of a second embodiment of an accessory according to the present invention on the head of a user.
Figure 4:
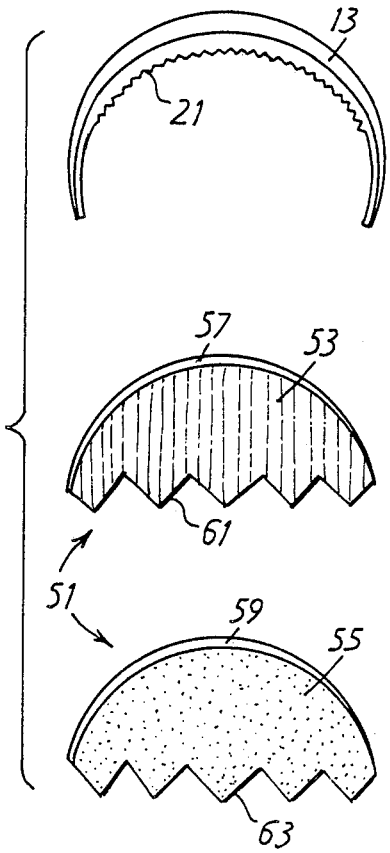
FIG. 4 is a view of constituent parts of the accessory of FIG. 3.

Referring to FIGS. 3 and 4, there is shown a second accessory comprising a fringe 51, in two layers 53 and 55, attached to an arch 13 of the same kind as the arch shown in FIGS. 1 and 2, having serrations 21.

The arch of the accessory also comprises subsidiary bands or strips 57 and 59 consisting of double lengths of fabric similar to strip 23, with the edges of layers 53 and 55 of the fringe 51 glued between the two lengths of the respective strips 57 and 59. The layers 53 and 55 are composed of imitation hair, layer 53 being light in colour and layer 55 being dark. The lower edges 61, 63 of the layers are cut to similar zig-zag shapes, with the length of hairs in the darker layer being on the average longer. To form the complete article shown in FIG. 3, the two strips 57 and 59 are glued to the underside of the arch 13 so that in use the strips are not visible and the darker layer 55 lies beneath the lighter one 53 with the zig-zag lower edge 63 appearing beneath the similarly-cut edge 61 of the layer 53 to display the two colours and the zig-zags in a striking manner. The accessory can be supplied complete and in order to wear it, the arch 13 is positioned on the head of the user so that the ends thereof lie behind the user's ears and the serrations 21 engage the user's own head or hair, with the two layers of the fringe 51 extending forwards. The central portion of the arch can be moved up and down the head to select a position for the fringe extending over more or less of the user's forehead, as desired.

Figure 5:
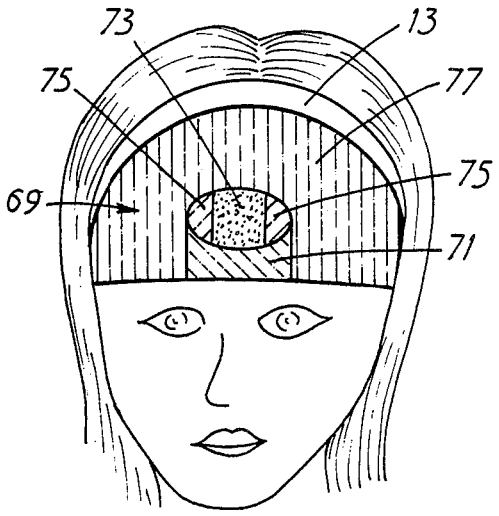
FIG. 5 is a view of a third embodiment of an accessory according to the invention on the head of a user.
Figure 6:
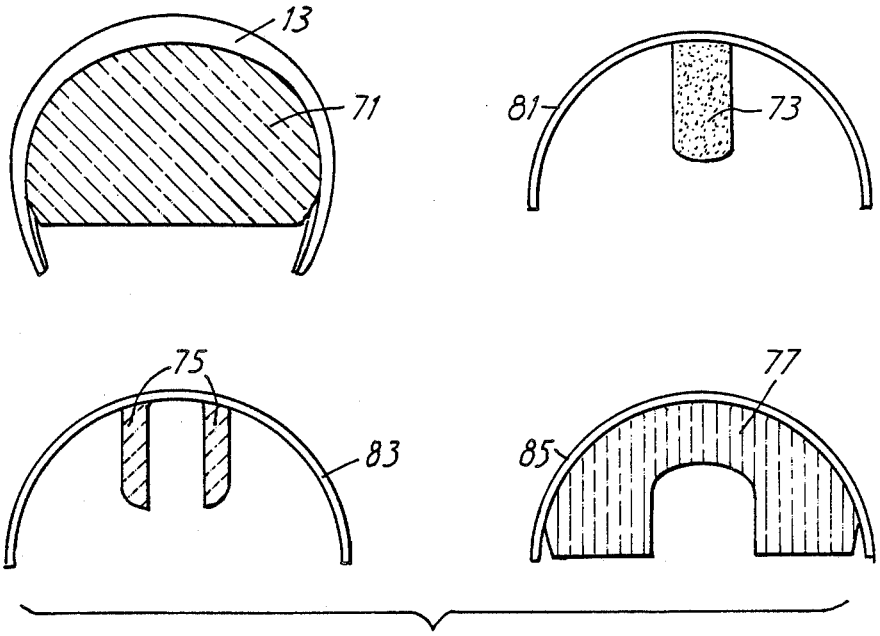
FIG. 6 is a view of the constituent parts of the accessory of FIG. 5.

FIGS. 5 and 6 show a third embodiment of the invention which has a similar construction to the embodiment of FIGS. 3 and 4, the main difference residing in the layers of the fringe 69, of which there are four: 71, 73, 75 and 77. The two layers 71 and 77 are the same colour whilst layers 73 and 75 are both different colours which contrast with the first colour. For example, layers 71 and 77 could be black, layer 73 blue and layer 75 white to give the effect of an eye in the complete fringe. Layer 71 is attached directly by any suitable means to arch 13, whilst the other layers 73, 75 and 77 are attached to respective fabric strips 81, 83 and 85. In the complete article the strips are attached to the underside of the arch 13 in front of the layer 71, layer 77 foremost, layer 73 on top of rear layer 71 and layer 75 between this and the front layer.

It will be appreciated that any number of accessories all differing in appearance can be made by varying the colours and materials of the layers, their lengths and the shapes of their lower edges, and by appropriate attachement of the upper edges of the layers so that at least a portion of each layer is visible. Fringes with one or more layers of real or synthetic hair resembling the colour of the user's own hair could be used to create a fringe or to supplement an existing fringe. For more noticeable effects, the fringe could be formed of straight, brightly coloured red or synthetic hair, or formed of ringlets in one or more colours. Both ends of the fringe material could be joined to the arch or the double fabric strips so that the fringe is formed of loops. Furthermore, layers could be attached by stitching rather than glue to the strips such as 23, or the fabric strips could be replaced by plastic or metal strips with the fringe material (e.g. plastic imitation hair) glued or fused thereto. The strips need not be permanently connected to the arch 13, and attachment means such as releasable poppers or "Velcro" (trade mark) could provide the connection. One side of the "Velcro" could be attached to the strips supporting the fringe layers and the other side secured, instead of to a arch such as arch 13, to the underside of an elasticated hair band formed in a loop, for example. Alternatively, the layers could be attached directly to arch 13 by any suitable means such as glue or fusing. The layers could also be sewn or otherwise attached to a woven layer which is attached by glue or the like to a arch. The horseshoe-shaped arch 13 with serrations is convenient because it is easily received and retained on the head and is adjustable for height. However, it could be replaced by a complete loop such as a wire circle wrapped in silk or satin, with a fringe attached to one section thereof. This form is particularly suitable for the attachment of soft ringlets.

Instead of being provided as a complete article, the accessory of FIGS. 3 and 4 or FIGS. 5 and 6 could be supplied in the form of a kit of parts comprising a arch and a plurality of strips with layers of fringe attached thereto. Accessories could be provided with fringe layers pre-cut to the desired shape or, preferably, there could be several layers, all of a uniform length and in different colours. A user can follow a pattern or design a frine by cutting some or all of the layers before or after attaching them to the arch. If the layers are removable and some layers remain unused, different fringes can be created from the kit.

The material of the fringe need not resemble hair, but could be composed of strips of materials such as metal, plastic, fabric or the like. Examples of such fringes are illustrated in FIGS. 7 to 12.

Figure 7:
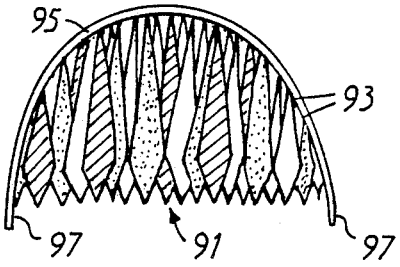
FIG. 7 is a view of a fourth embodiment of an accessory according to the invention where the fringe comprises strips.
Figure 8:
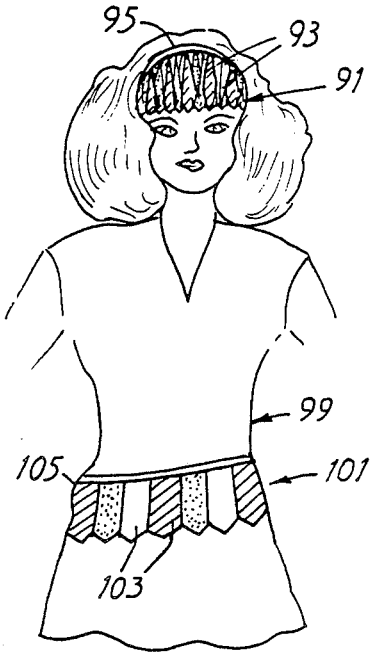
FIG. 8 is a view of the accessory of FIG. 7 on a wearer.

Referring now to FIGS. 7 and 8 there is shown an accessory for the hair comprising a fringe 91 formed of a large number of strips 93 having elongated diamond shapes, all attached to an arch 95.

The strips 93 are formed of brightly coloured plastics material with a metallic finish and each strip at its upper end is attached to the arch 95 by glue, heat welding or any other suitable means. The strips are thin and lightweight so that they hang in overlapping fashion and tend to swing and vary in relative positions as the wearer moves. There are three different colours of elongated diamond-shaped strips 93 (e.g. red, pink and orange), giving a striking effect.

The arch 95 is a resilient strip of firm plastics material, similar to arch 13 of FIGS. 1 to 6. The arch is curved, so that the two ends 97 can be located behind the ears of the wearer, to retain the fringe in the desired position, and the rear underside edge (not shown) is formed with a row of serrations as in arch 13 to assist in retaining the fringe in position.

FIG. 8 shows the fringe 91 and arch 95 on the head of a wearer 99. The fringe is worn with a matching belt 101 having the same colour scheme and comprising plastic strips 103 attached to a arch 105.

Figure 9:
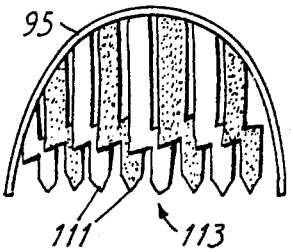
FIG. 9 is a view of a fifth embodiment of an accessory according to the invention comprising differently shaped strips.

FIG. 9 shows a second kind of accessory having plastic strips instead of real or imitation hair, again with a resilient plastics arch 95, but with differently shaped plastics strips 111 forming a fringe 113. The strips 111 all have the same basic zig-zag shape and are cut to length to give a straight edge to the fringe. The strips 111, like strips 93, are made of lightweight plastics material with a metallic finish and they are attached to arch 95 so as to alternate in colour with slight overlap of the zig-zags.

Figure 10:
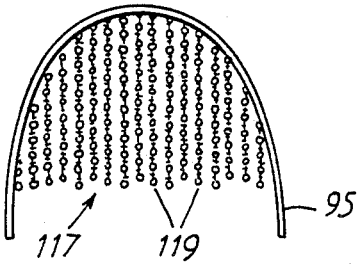
FIG. 10 is a view of a sixth embodiment of an accessory according to the invention comprising strings of beads.
Figure 11:
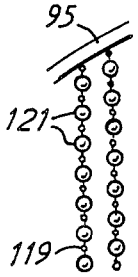
FIG. 11 is a view in more detail of part of the accessory of FIG. 10 showing two strings of beads on a arch.
Figure 12:
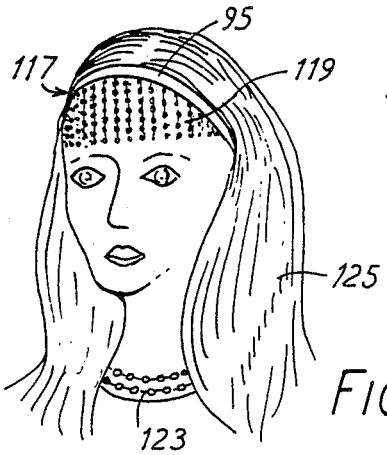
FIG. 12 is a view of the accessory of FIGS. 10 and 11 on a wearer.

Referring now to FIGS. 10, 11 and 12, these Figures show an arch 95 with a fringe 117 comprising strings 119 of beads 121. As shown most clearly in FIG. 11, a number of threads is attached to the arch 75 and each thread carries a variety of small beads 121 of different colours and sizes. As shown in FIG. 12, the beads of the fringe 117 can be co-ordinated with similar beads of a necklace 123 on a wearer 125.

Strips similar to those in FIGS. 7, 8 and 9 could be formed of any suitable material such as metal, plastic or fabric, in any desired shapes. They could be attached to the arch by stitching, glue or fusing for example, or in a releasable manner using poppers, hooks, "Velcro" (trade mark) of the like. Instead of being flat, the strips may be coiled or crimped to create special effects. Strings of beads, if used alternatively or in addition to strips, can include beads or similar objects of sizes, shapes and materials as desired. The beads could be permanently strung on threads of cotton, nylon or the like if the threads are fixed to the arch. If the threads are looped so as to be engaged on hooks on the arch, or are otherwise removable from the, the beads could be replaced by different beads to suit the colour combination of particular clothes or accessories of the wearer.

Accessories such as those shown in FIGS. 7 to 12 could be made up from a kit of parts consisting of varieties of strips and/or beads or strings of beads so that the wearer can choose the kind of fringe to attach to the arch. The accessory or kit of parts could be sold with matching accessories of different kinds, such as belts, necklaces or bracelets.

I claim:

1. A hair accessory, comprising a single decorative, horseshoe-shaped arch having an inner and an outer surface, made of rigid material and adapted, in use, releasably to engage, be retained on and extend substantially from ear to ear over a forward part of the head of the wearer so as to be visible on top of the hair of the wearer, and a fringe having a free end and remotely therefrom a further end attached to said arch at said inside surface thereof so as, in use, to extend from one side only of said arch forwardly over the hair at the front of the head and over the forehead of the wearer.

2. An accessory as claimed in claim 1, wherein the fringe comprises strips, and/or strings of beads, depending from the arch.

3. An accessory as claimed in claim 2, wherein the fringe comprises strips attached so as to depend in overlapping fashion.

4. An accessory as claimed in claim 1, wherein the fringe has two or more layers similarly or differently coloured each attached to the arch so as, in use, to overlie the forehead of the user.

5. An accessory as claimed in claim 4, wherein the layers are differently coloured and overlap so as to present, in use, differently coloured portions of respective layers.

* * * * *